US006345397B1

(12) United States Patent
Haubrich

(10) Patent No.: US 6,345,397 B1
(45) Date of Patent: Feb. 12, 2002

(54) OUTDOOR FAUCET ATTACHMENT

(76) Inventor: Mark A. Haubrich, 35586 C44, Le Mars, IA (US) 51031

( * ) Notice: Subject to any disclaimer, the term of this patent is extended or adjusted under 35 U.S.C. 154(b) by 0 days.

(21) Appl. No.: 09/660,372

(22) Filed: Sep. 12, 2000

(51) Int. Cl.[7] ..... A47K 3/00
(52) U.S. Cl. ..... 4/615; 4/601
(58) Field of Search ..... 4/615, 675, 678, 4/DIG. 7, 601; 137/873, 883, 615, 801, 276; 239/279

(56) References Cited

U.S. PATENT DOCUMENTS 1,218,879 A * 3/1917 Luzzi ..... 4/615
1,501,762 A * 7/1924 Ferguson ..... 4/601
1,799,815 A * 4/1931 Hoff ..... 4/615
4,720,878 A * 1/1988 Viner ..... 4/615
5,608,928 A * 3/1997 Wang ..... 4/678
5,871,029 A * 2/1999 Peteri e tal. ..... 4/678
5,983,419 A * 11/1999 Carroll ..... 4/601
5,996,142 A * 12/1999 Colman ..... 4/615

* cited by examiner

*Primary Examiner*—Charles R. Eloshway
(74) *Attorney, Agent, or Firm*—Henderson & Sturm LLP

(57) ABSTRACT

An attachment for increasing the distance of the fluid outlet of a conventional, hand-operated faucet above a substantially horizontal level surface, the attachment being an S-shaped tube with one end fluidly connected to the outlet and the other end located higher than the fluid outlet relative to the surface.

2 Claims, 2 Drawing Sheets

OUTDOOR FAUCET ATTACHMENT

CROSS-REFERENCE TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates generally to wall-mounted or like water faucets, and specifically to such faucets which are mounted too low to the ground or other surface to enable a conventional water bucket or like container to be placed in a flat manner therebelow to receive water.

2. Description of the Prior Art

For those who love gardening, one of the most frustrating aspects thereof is the inability to place a conventional water bucket or other container flat on the ground or other surface below the outlet of the faucet to receive water. Similar disadvantageous arrangements are not restricted to the outside of a house or other structure, but are also found within garages, laundry facilities and in commercial structures. The reasons are varied and one can lay blame to any number of the construction personnel. Regardless, we end up tipping the containers, connecting hoses and other such solutions, none too satisfactory. It would appear that an uncomplicated piece of hardware easily used by all, easily manufactured and distributed would be the solution; but other than short lengths of hoses, some available at hardware-type stores and others homemade, these are the only solutions available to the inventor's knowledge.

SUMMARY OF THE INVENTION

The present invention relates to a faucet attachment which comprises an S-shaped hollow tube device, one end of which is attached to the outlet end of a conventional wall or like mounted water faucet, and the other end of which is disposed higher from the ground or other surface than the outlet end. The connection of the tube device with the outlet end is of a swivel nature whereby the tube device can be pivotally swung one way or the other structure from which the faucet protrudes.

More particularly, the invention comprises a pair of gooseneck tubes, each having a gooseneck end and a straight portion. The straight portions are telescopically and pivotally connected, with one of the gooseneck ends fluidly coupled with the faucet end, such that the opposite gooseneck end is higher from the ground or other surface than the faucet end.

A normally closed ball-type valve may be fluidly connected to one of the straight portions whereby a garden hose may be connected thereto, and another hand-operated valve may be fluidly connected to a straight tube portion for controlling fluid to the upper gooseneck end.

The invention provides for better utilization of existing faucets in a neat compact unit; it provides for a dual usage of the existing faucet, one to fill containers such as watering cans, and one for a hose attachment. With the capability of the existing faucet connection to swivel, the entire attachment may be swivelled to be disposed flat with a wall; and with the upper gooseneck end capable of swiveling and telescoping, that end is capable of allowing more clearance for large containers.

BRIEF DESCRIPTION OF THE SEVERAL VIEWS OF THE DRAWINGS

These and other attributes of the invention will become more clear upon making a thorough review and study of the following description of a preferred embodiment, particularly when reviewed in conjunction with the drawings, wherein.

DETAILED DESCRIPTION OF THE INVENTION

Figure 1:
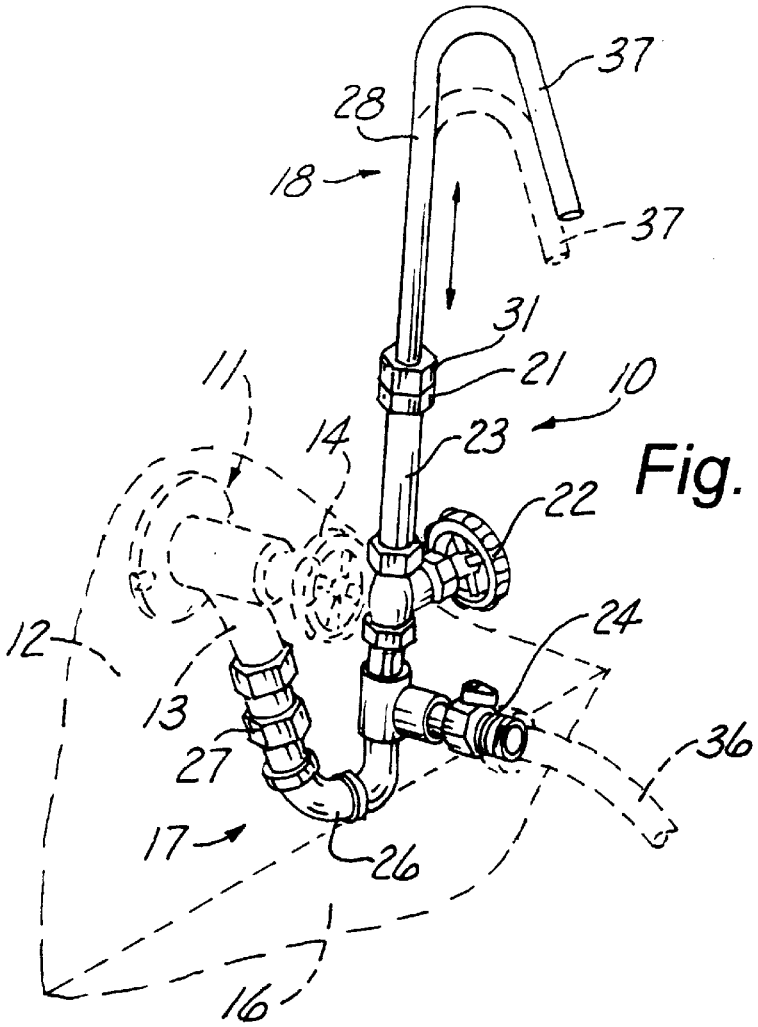
FIG. 1 is a side elevational view of the faucet attachment of this invention, with existing structure shown in dashed lines, and with a telescoping gooseneck end shown in dashed lines.

Referring to FIG. 1, the preferred embodiment of the faucet attachment of this invention is illustrated by the reference numeral (10), and is adapted as hereinafter described to be attached to a conventional water faucet (11) mounted on a wall (12) with a water outlet (13), controlled by a hand-operated valve (14), located at a certain distance above the substantially level ground (16) or other surface.

Figure 2:
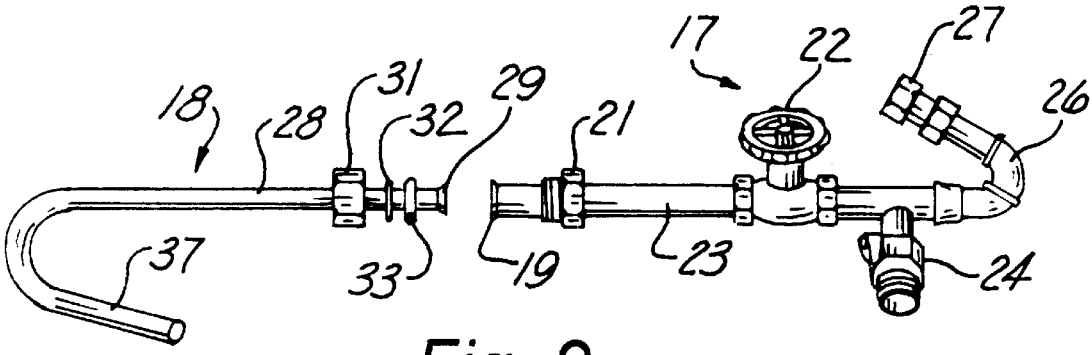
FIG. 2 is an exploded view of the faucet attachment of this invention.

The faucet attachment (10) comprises an S-shaped tube including a pair of goosenecked ends (17) and (18) (FIG. 2), end (17) being a base end. Base end (17) includes a flared end (19), with a female flare nut (21), a hand-operated valve (22) interposed in a straight section (23), to control the flow of fluid through the base end (17). Below the valve (22) is a built in normally closed ball valve (24), a U-shaped fitting (26), with a double swivel connector (27) for fluid connection to the water faucet outlet (13).

The opposite end (18) also has a straight section (28), with a flared end (29), a male flare nut (31) with a steel washer (32) and rubber washer (33) to provide a combined telescopic and swivel connection between the straight sections (23) and (28) of the respective goosenecked ends (17) and (18); and the flared ends prevent the nuts from sliding off.

The faucet attachment (10) has a preferred length of approximately fourteen inches, with the capability of telescoping the upper end (18) to nineteen inches. The double swivel connector (27) provides for a 360° swivel, although due to the mounting, 180° is the normal swing. This provides for the attachment (10) to be swung to a relatively flat position against the wall (12), keeping the attachment (10) out of the way of lawnmowers, people and the like.

Figure 3:
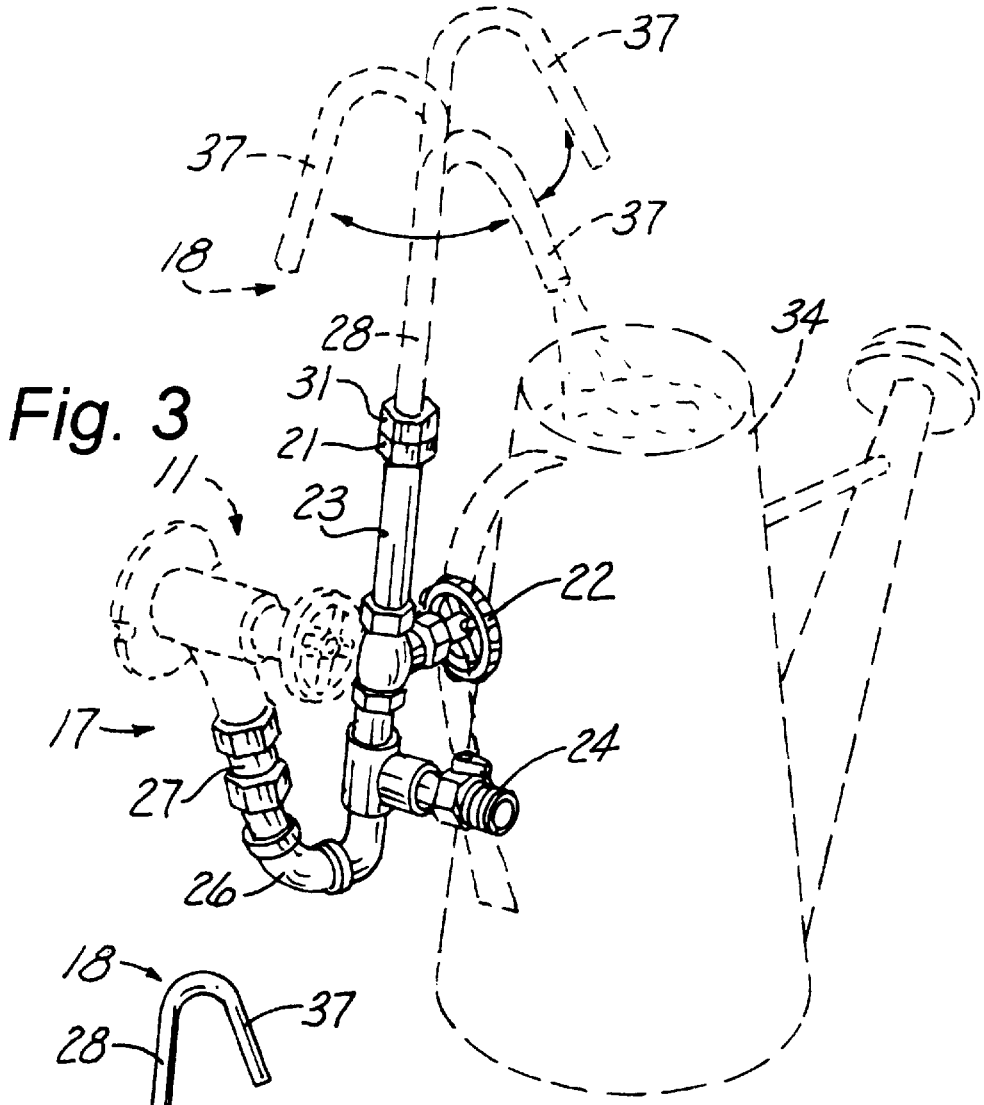
FIG. 3 is a view similar to FIG. 1, showing swiveling and telescoping capability of the faucet attachment by the use of dashed lines.
Figure 4:
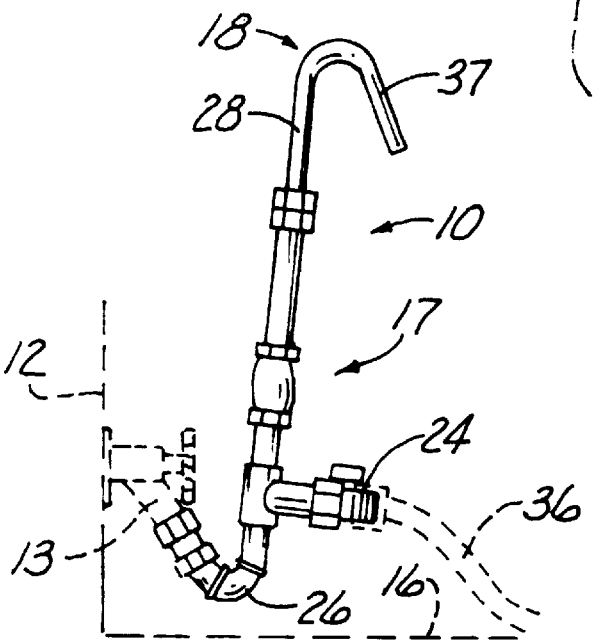
FIG. 4 is a reduced side elevational view.

The upper end (18) can also be extended and swivelled to accommodate larger or different sized water containers (34) as best illustrated in FIG. 3. The double swivel (27) may be set at a slight angle (see FIG. 4) to allow for a convenient hook-up to the house faucet (11), and the valve (24) may be extended outwardly for easy connection to a garden hose (36).

It is thus seen that the aforementioned embodiment may accomplish its objectives of providing for a duel usage of the conventional faucet, but as importantly placing the water outlet at the upper end (37) of the attachment at a distance from the ground (16) greater than that of the house faucet (11), and whereby the attachment outlet end (37) is spaced vertically higher than the faucet outlet (13).

Although the preferred embodiment is shown, it should be noted that he double-swivel connector (27) may be changed to a single swivel for production run units; the U-shaped fitting (26) may be removed completely by a U-shaped bond in the tube (23); and the valve (22) may be eliminated or replaced with a more contemporary valve. These, and other modifications may be made within the spirit and scope of the appended claims.

I claim:

1. For use with a conventional fluid faucet mounted on a normally vertical wall surface, the faucet having a hand-operated valve for opening and closing a fluid outlet, the fluid outlet spaced a certain vertical distance above a substantially horizontal floor level and facing downwardly at an acute angle from the wall surface; an attachment for increasing the vertical distance of the fluid outlet above the floor level comprising:

an S-shaped tube including a pair of goose-necked ends arranged so that, in use, one of said ends is fluidly connected to the fluid outlet, the other end being spaced vertically higher than the fluid outlet;

said tube having a lower portion including said one end, a hand-operated valve interposed in said lower portion for controlling the flow of fluid to said other end; and said tube having further an upper portion swivelly connected to said lower portion and including said other end.

2. The attachment as in claim 1, and including further a double swivel connector at said one end for fluid connection to the fluid outlet, whereby said S-shaped tube can be swung to a relatively flat position against the wall.

* * * * *